US010068685B1

(12) United States Patent
Cook

(10) Patent No.: US 10,068,685 B1
(45) Date of Patent: Sep. 4, 2018

(54) COMMUNICATION CABLES WITH SEPARATORS HAVING ALTERNATING PROJECTIONS

(71) Applicant: Superior Essex International LP, Atlanta, GA (US)

(72) Inventor: Thomas Christopher Cook, Woodstock, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 15/435,685

(22) Filed: Feb. 17, 2017

Related U.S. Application Data

(63) Continuation-in-part of application No. 15/345,775, filed on Nov. 8, 2016.

(51) Int. Cl.
*H01B 11/04* (2006.01)
*H01B 11/08* (2006.01)
(Continued)

(52) U.S. Cl.
CPC ..... *H01B 11/04* (2013.01); *H01B 7/18* (2013.01); *H01B 7/182* (2013.01); *H01B 7/1805* (2013.01);
(Continued)

(58) Field of Classification Search
CPC ..... H01B 11/04; H01B 11/08; H01B 9/00; H01B 9/028; H01B 7/04; H01B 7/009;
(Continued)

(56) References Cited

U.S. PATENT DOCUMENTS 1,389,143 A 8/1921 Kempton
2,538,019 A 1/1951 Edwin
(Continued)

FOREIGN PATENT DOCUMENTS

EP 0915486 11/1998
EP 1632957 5/2005
(Continued)

OTHER PUBLICATIONS

Non-Final Office Action for U.S. Appl. No. 15/345,775, dated Jun. 26, 2017.
(Continued)

*Primary Examiner* — Ishwarbhai B Patel
*Assistant Examiner* — Paresh Paghadal

(57) ABSTRACT

A cable may include a plurality of twisted pairs of individually insulated conductors, a separator positioned between the twisted pairs, and a jacket formed around the twisted pairs and the separator. The separator may include a longitudinally extending spine positioned between the plurality of twisted pairs, and at least one prong respectively extending from the spine at each of a plurality of longitudinally spaced locations. Additionally, for each pair of adjacent longitudinally spaced locations, the at least one prong extending at a first of the pair of locations may extend in a first set of one or more directions and the at least one prong extending at a second of the pair of locations may extend in a second set of one or more directions that is different than the first set of one or more directions.

10 Claims, 7 Drawing Sheets

(51) Int. Cl.

| | |
|---|---|
| ***H01B 11/06*** | (2006.01) |
| ***H01B 7/18*** | (2006.01) |
| *H01B 7/00* | (2006.01) |
| *H01B 7/28* | (2006.01) |
| *H01B 7/04* | (2006.01) |
| *H01B 11/00* | (2006.01) |
| *H01B 9/00* | (2006.01) |
| *H01B 7/32* | (2006.01) |
| *H01B 9/02* | (2006.01) |
| *H01B 13/00* | (2006.01) |

(52) U.S. Cl.
CPC ..... *H01B 7/1895* (2013.01); *H01B 11/06* (2013.01); *H01B 11/08* (2013.01); *H01B 7/00* (2013.01); *H01B 7/009* (2013.01); *H01B 7/04* (2013.01); *H01B 7/041* (2013.01); *H01B 7/28* (2013.01); *H01B 7/32* (2013.01); *H01B 9/00* (2013.01); *H01B 9/028* (2013.01); *H01B 11/00* (2013.01); *H01B 13/00* (2013.01)

(58) Field of Classification Search
CPC . H01B 7/28; H01B 7/32; H01B 7/041; H01B 7/182; H01B 7/1895; H01B 7/18; H01B 7/1805; H01B 11/00; H01B 13/00; H01B 11/06; H01B 7/00; G02N 6/4434; G02N 6/4407; G02N 6/4414
See application file for complete search history.

(56) References Cited

U.S. PATENT DOCUMENTS

| | | | |
|---|---|---|---|
| 2,796,463 | A | 6/1957 | Mallindrodt |
| 3,090,825 | A | 5/1963 | Volk |
| 3,135,935 | A | 6/1964 | Eugelbrecht |
| 3,312,774 | A | 4/1967 | Drinko |
| 3,373,475 | A | 3/1968 | Peterson |
| 3,612,744 | A | 10/1971 | Thomas |
| 4,165,442 | A | 8/1979 | Gabriel |
| 4,604,497 | A | 8/1986 | Bell et al. |
| 4,638,272 | A | 1/1987 | Ive |
| 4,746,767 | A | 5/1988 | Gruhn |
| 4,784,462 | A | 11/1988 | Priaroggia |
| 4,807,962 | A | 2/1989 | Arroyo |
| 4,881,642 | A | 11/1989 | Adam |
| 5,006,806 | A | 4/1991 | Rippingale |
| 5,008,489 | A | 4/1991 | Weeks et al. |
| 5,106,175 | A | 4/1992 | Davis et al. |
| 5,114,517 | A | 5/1992 | Rippingale et al. |
| 5,177,809 | A | 1/1993 | Zeidler |
| 5,789,711 | A | 8/1998 | Gaeris |
| 5,952,615 | A | 9/1999 | Prudhon |
| 5,956,445 | A | 9/1999 | Deitz et al. |
| 6,222,130 | B1 | 4/2001 | Gareis |
| 6,248,954 | B1 | 6/2001 | Clark |
| 6,288,340 | B1 | 9/2001 | Arnould |
| 6,297,454 | B1 | 10/2001 | Gareis |
| 6,310,295 | B1 | 10/2001 | Despard |
| 6,365,836 | B1 | 4/2002 | Blouin |
| 6,506,976 | B1 | 1/2003 | Neveux, Jr. |
| 6,570,095 | B2 | 5/2003 | Clark |
| 6,596,944 | B1 | 7/2003 | Clark |
| 6,624,359 | B2 | 9/2003 | Bahlmann |
| 6,639,152 | B2 | 10/2003 | Glew |
| 6,687,437 | B1 | 2/2004 | Starnes et al. |
| 6,723,925 | B2 | 4/2004 | Ohara et al. |
| 6,737,574 | B2 | 5/2004 | Sylvia et al. |
| 6,770,819 | B2 | 8/2004 | Patel |
| 6,800,811 | B1 | 10/2004 | Boucino |
| 6,812,408 | B2 | 11/2004 | Clark |
| 6,850,161 | B1 | 2/2005 | Elliott |
| 6,888,070 | B1 | 5/2005 | Prescott |
| 7,098,405 | B2 | 8/2006 | Glew |
| 7,173,189 | B1 | 2/2007 | Hazy et al. |
| 7,179,999 | B2 | 2/2007 | Clark et al. |
| 7,196,271 | B2 | 3/2007 | Cornibert |
| 7,329,815 | B2 | 2/2008 | Kenny et al. |
| 7,332,676 | B2 | 2/2008 | Sparrowhawk |
| 7,335,837 | B2 | 2/2008 | Pfeiler et al. |
| 7,834,271 | B2 | 11/2010 | Gromko et al. |
| 7,923,632 | B2 | 4/2011 | Smith et al. |
| 8,119,907 | B1 | 2/2012 | McNutt |
| 8,313,346 | B2 | 11/2012 | Sparrowhawk |
| 8,445,787 | B2 | 5/2013 | Nordin |
| 8,558,115 | B2 | 10/2013 | Jenner et al. |
| 9,136,043 | B2 | 9/2015 | Brown |
| 2003/0111241 | A1 | 6/2003 | Bahlmann |
| 2003/0217863 | A1 | 11/2003 | Clark et al. |
| 2003/0230427 | A1 | 12/2003 | Gareis |
| 2004/0035603 | A1 | 2/2004 | Clark |
| 2004/0055781 | A1 | 3/2004 | Comibert |
| 2006/0048961 | A1 | 3/2006 | Pfeiler et al. |
| 2006/0131057 | A1 | 6/2006 | Lique |
| 2007/0037419 | A1 | 2/2007 | Sparrowhawk |
| 2007/0044995 | A1* | 3/2007 | Park ..... H01B 11/06 174/113 C |
| 2007/0193769 | A1 | 8/2007 | Clark |
| 2007/0224495 | A1 | 9/2007 | Gibbons et al. |
| 2007/0275583 | A1 | 11/2007 | McNutt |
| 2008/0255435 | A1 | 10/2008 | Al-Ali et al. |
| 2008/0264670 | A1 | 10/2008 | Glew |
| 2008/0314636 | A1 | 12/2008 | Ogura |
| 2010/0096179 | A1* | 4/2010 | Sparrowhawk ..... H04B 3/32 174/350 |
| 2011/0147039 | A1 | 6/2011 | Smith et al. |
| 2013/0008684 | A1* | 1/2013 | Weitzel ..... H01B 13/0026 174/107 |
| 2014/0252425 | A1 | 9/2014 | Hopkinson et al. |

FOREIGN PATENT DOCUMENTS

| | | |
|---|---|---|
| GB | 2432963 | 6/2007 |
| JP | 2000090748 | 3/2000 |
| JP | 2004311120 | 11/2004 |
| JP | 2006173044 | 6/2006 |
| WO | WO2006105166 | 5/2006 |
| WO | WO2011020967 | 2/2011 |

OTHER PUBLICATIONS

Notice of Allowance for U.S. Appl. No. 15/455,182, dated Jun. 28, 2017.
"Product Catalogue" 2 pages, Enterprise Cabling R&M, May 2006.
"Draka" 12 pages, Draka Comtez, Cable Solutions, Data Cables, Sep. 27, 2006.
"10 Gigabit Ethernet Solutions" 8 pages, R&M Convincing Cable Solutons.
Wetzikon, "R&M: The Rising Stars in Copper Cabling" 2 pages, Sep. 1, 2005.
"R&M Star Real 10" 2 pages, Mar. 2006.
"Connections 29" 36 pages, Sep. 2005.
Pfeiler et al., U.S. Pat. No. 7,335,837, issued Feb. 26, 2008.
First Office Aciton for U.S. Appl. No. 15/227,365, dated Apr. 17, 2017.
Notice of Allowance for U.S. Appl. No. 15/227,365, dated Nov. 14, 2017.
Office Action for U.S. Appl. No. 15/252,775, dated Oct. 31, 2017.
Office Action for U.S. Appl. No. 15/345,775, dated Dec. 21, 2017.
Office Action for U.S. Appl. No. 15/277,390, dated Jan. 17, 2018.
Non-Final Office Action for U.S. Appl. No. 15/227,390, dated Aug. 30, 2017.

* cited by examiner

COMMUNICATION CABLES WITH SEPARATORS HAVING ALTERNATING PROJECTIONS

CROSS REFERENCE TO RELATED APPLICATION

This application is a continuation-in-part of U.S. patent application Ser. No. 15/345,775, filed Nov. 8, 2016, and entitled "Communication Cables with Twisted Tape Separators", the contents of which is incorporated by reference herein in its entirety.

TECHNICAL FIELD

Embodiments of the disclosure relate generally to communication cables and, more particularly, to communication cables incorporating separators that include projections that extend from a central portion in alternating or varying directions along a longitudinal length.

BACKGROUND

A wide variety of different types of cables are utilized to transmit power and/or communications signals. In certain types of cables, it is desirable to provide separation for internal cable components. For example, certain cables make use of multiple twisted pairs of conductors to communicate signals. In each pair, the wires are twisted together in a helical fashion to form a balanced transmission line. When twisted pairs are placed in close proximity, such as within the core of a cable, electrical energy may be transferred from one pair of the cable to another pair. Such energy transfer between pairs is undesirable and is referred to as crosstalk. Crosstalk causes interference to the information being transmitted through the twisted pairs and can reduce the data transmission rate and cause an increase in bit rate error. Interlinking typically occurs when two adjacent twisted pairs are pressed together, and interlinking can lead to an increase in crosstalk among the wires of adjacent twisted pairs.

In order to improve crosstalk performance, separators (also referred to as separation fillers, fillers, interior supports, or splines) have been inserted into many conventional cables. These separators serve to separate adjacent twisted pairs and limit or prevent interlinking of the twisted pairs. However, many conventional separators are often formed as preformed structures, such as preformed cross-fillers, that include four projections or fins that continuously extend along a longitudinal length of a cable, thereby increasing an amount of required material and reducing the overall flexibility of the separators and cables. Alternatively, relatively flat tape structures have been utilized that bisect a cable core and do not provide separation between each set of adjacent twisted pairs. Accordingly, there is an opportunity for improved separator structures and cables incorporating the separators.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures.

Additionally, the drawings are provided to illustrate example embodiments described herein and are not intended to limit the scope of the disclosure.

DETAILED DESCRIPTION

Figure 1A:
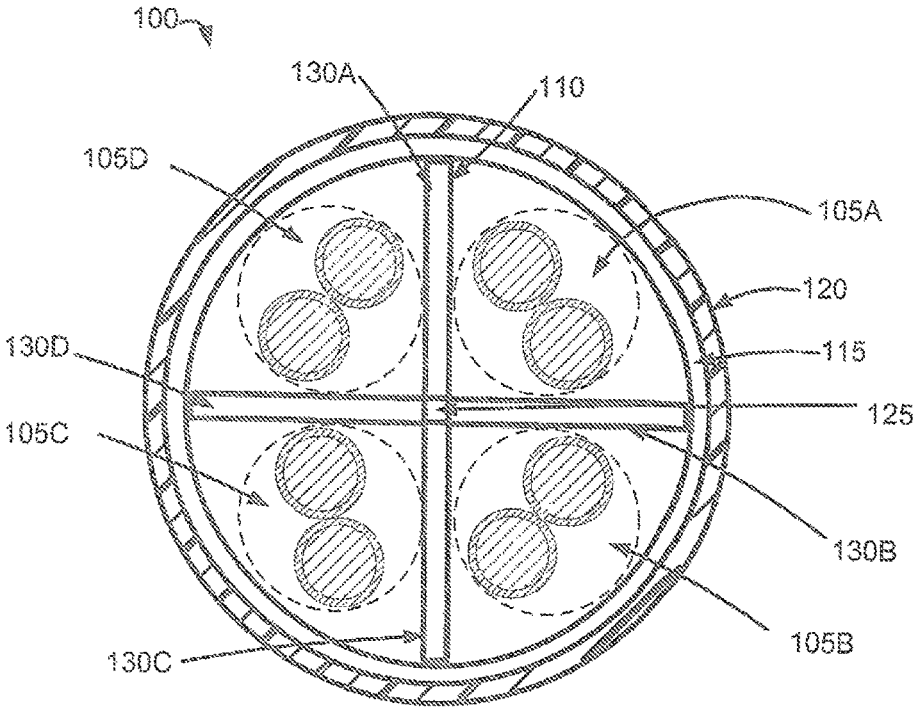
FIGS. 1A and 1B are cross-sectional views of example twisted pair cables incorporating separators that include a plurality of projections that extend in different directions at various locations along a longitudinal length, according to an illustrative embodiment of the disclosure.

Various embodiments of the present disclosure are directed to twisted pair communication cables that incorporate separators including a plurality of projections that extend from a spine or central portion in a different directions or sets or directions along a longitudinal length. In one example embodiment, a cable may include a plurality of longitudinally extending twisted pairs of individually insulated conductors and a jacket or other suitable layer (e.g., a shield layer, etc.) formed around the plurality of twisted pairs. A separator may be positioned between the plurality of twisted pairs. The separator may include a central portion, such as a central spine, that is positioned between the plurality of twisted pairs. Additionally, a plurality of projections may extend from the spine with each projection extending between a set of adjacent twisted pairs. According to an aspect of the disclosure, respective sets of one or more projections may be longitudinally spaced along the spine, and each adjacent set of projections may extend from the spine in different sets of directions. In other words, the angles of extension for the longitudinally spaced projections may be alternated or otherwise varied.

A wide variety of suitable configurations of projections may be utilized as desired in various embodiments. Additionally, any suitable number of projections may extend from a central portion at a given longitudinally spaced location. In certain embodiments, single projections may alternate directions of extension from a central portion at approximately ninety degree (90°) angles. In other embodiments, two projections may extend from each longitudinally spaced location in opposite directions from the central portion. The directions of extension may then alternate by approximately one hundred and eighty degrees (180°) between adjacent spaced locations. For example, projections may alternate between up/down and left/right orientations. In yet other embodiments, three projections may extend from each longitudinally spaced location, and a projection that is not present may be alternated at approximately ninety degree (90°) angles. A wide variety of other suitable configurations may be utilized as desired. Additionally, in certain embodiments, longitudinally spaced locations at which projections extend may be situated immediately adjacent to one another in an end to end manner along a longitudinal length of a separator. In other embodiments, a suitable gap or longitudinal space may be present between at least two adjacent longitudinally spaced locations.

In certain embodiments, a cable or cable component may be formed with four twisted pairs of conductors. Additionally, a separator may function as a cross-filler that includes projections or fins that provide separation between each adjacent set of twisted pairs along a longitudinal length. However, at any given location along the longitudinal length, projections do not extend between all of the twisted pairs. For example, alternating arrangements of projections or arrangements in which varying directions of extension are utilized for respective sets of projections may be utilized. As a result, a cross-filler separator may be formed that includes less material than conventional cross-fillers, thereby reducing material costs and/or enhancing the flexibility of the separator. Similar arrangements of projections may be utilized for cables or cable components with more or less than four twisted pairs.

For purposes of this disclosure, a projection, prong, fin, or extension may include any suitable projection or other component that radially extends from a spine or central portion. In certain embodiments, each projection may extend between an adjacent set of twisted pairs, thereby providing separation between the twisted pairs that may enhance the electrical performance of a cable or cable component. A projection may be formed with any suitable dimensions, such as any suitable cross-sectional shape, cross-sectional area, thickness, distance of projection (i.e., length of projection from the spine), and/or longitudinal length. For example, a projection may be formed with a rectangular, parallelogram, trapezoidal, triangular, or other suitable cross-sectional shape. Additionally, a projection may be formed from a wide variety of suitable materials and/or combinations of materials. In certain embodiments, shielding material (e.g., electrically conductive material, semi-conductive material, dielectric shielding material, etc.) may be incorporated into one or more projections.

A central portion may also be formed with a wide variety of suitable dimensions, such as a wide variety of suitable cross-sectional shapes, cross-sectional areas, and/or other dimensions. In certain embodiments, a central portion can be formed from a single longitudinally continuous section that extends approximately an entire length of a cable or cable component. In other embodiments, as explained in greater detail below, a central portion may be formed from a plurality of longitudinally arranged discrete or separate portions, such as a plurality of sections or portions that are positioned end to end along a longitudinal length of a cable. A central portion may also be formed from a wide variety of suitable materials and/or combinations of materials including, but not limited to, dielectric materials (e.g., polymeric materials, etc.), conductive materials, semi-conductive materials, etc.

A wide variety of suitable methods or techniques may be utilized as desired to form a separator and incorporate a separator into a cable or cable component. In certain embodiments, a separator (or any number of separator sections) may be extruded, molded, or otherwise formed with a predetermined configuration (i.e., projections extending in desired directions). The separator may then be positioned between a plurality of twisted pairs. In other embodiments, a separator may be formed with projections extending in one or more initial directions, and the separator may then be twisted with any suitable period or lay prior to being positioned between a plurality of twisted pairs. As a result of the twisting, various projections may extend from the central portion in a plurality of various directions relative to their pre-twisted positions. For example, a separator may be formed with projections extending in a single direction (or a finite number of directions) and, when the central portion of the separator is twisted, the projections may be arranged in a desired pattern.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1A illustrates a cross-sectional view of an example twisted pair cable 100 incorporating a separator that includes a plurality of projections that extend in different directions at various longitudinally spaced locations. The cable 100 may include a plurality of twisted pairs 105A-D, a separator 110 positioned between the plurality of twisted pairs 105A-D, one or more optional shield layers (e.g., individual shields respectively formed around each of the twisted pairs, an overall shield 115 formed around the plurality of twisted pairs 105A-D and the separator 110, etc.), and a jacket 120 formed around the plurality of twisted pairs 105A-D and the separator 110. The cable 100 is illustrated as a twisted pair communications cable; however, other types of cables may be utilized, such as composite or hybrid cables including a combination of twisted pairs and other transmission media (e.g., optical fibers, etc.). Indeed, suitable cables may include any number of transmission media including, but not limited to, one or more twisted pairs, optical fibers, coaxial cables, and/or power conductors. Additionally, embodiments of the disclosure may be utilized in association with horizontal cables, vertical cables, flexible cables, equipment cords, cross-connect cords, plenum cables, riser cables, or any other appropriate cables. Each of the example components of the cable 100 are described below.

Although four twisted pairs 105A, 105B. 105C, 105D are illustrated in FIG. 1A, any other suitable number of pairs may be utilized. As desired, the twisted pairs 105A-D may be twisted or bundled together and/or suitable bindings may be wrapped around the twisted pairs 105A-D. In other embodiments, multiple grouping of twisted pairs may be incorporated into a cable, and any of the groupings may include a respective separator. Additionally, as desired, the multiple groupings may be twisted, bundled, or bound together.

Each twisted pair (referred to generally as twisted pair 105) may include two electrical conductors, each covered with suitable insulation. Each twisted pair 105 can carry data or some other form of information at any desirable frequency, such as a frequency that permits the overall cable 100 to carry data at approximately 600 MHz or greater. As desired, each of the twisted pairs may have the same twist lay length or alternatively, at least two of the twisted pairs may include a different twist lay length. For example, each twisted pair may have a different twist rate. The different twist lay lengths may function to reduce crosstalk between the twisted pairs. A wide variety of suitable twist lay length configurations may be utilized. In certain embodiments, the differences between twist rates of twisted pairs that are circumferentially adjacent one another (for example the twisted pair 105A and the twisted pair 105B) may be greater than the differences between twist rates of twisted pairs that are diagonal from one another (for example the twisted pair 105A and the twisted pair 105C). As a result of having similar twist rates, the twisted pairs that are diagonally disposed can be more susceptible to crosstalk issues than the twisted pairs 105 that are circumferentially adjacent; however, the distance between the diagonally disposed pairs may limit the crosstalk.

Additionally, in certain embodiments, each of the twisted pairs 105A-D may be twisted in the same direction (e.g., clockwise, counter clockwise). In other embodiments, at least two of the twisted pairs 105A-D may be twisted in opposite directions. Further, as desired in various embodiments, one or more of the twisted pairs 105A-D may be twisted in the same direction as an overall bunch lay of the combined twisted pairs. For example, the conductors of each of the twisted pairs 105A-D may be twisted together in a given direction. The plurality of twisted pairs 105A-D may then be twisted together in the same direction as each of the individual pair's conductors. In other embodiments, at least one of the twisted pairs 105A-D may have a pair twist direction that is opposite that of the overall bunch lay. For example, all of the twisted pairs 105A-D may have pair twist directions that are opposite that of the overall bunch lay.

The electrical conductors of a twisted pair 105 may be formed from any suitable electrically conductive material, such as copper, aluminum, silver, annealed copper, copper clad aluminum, gold, a conductive alloy, etc. Additionally, the electrical conductors may have any suitable diameter, gauge, cross-sectional shape (e.g., approximately circular, etc.) and/or other dimensions. Further, each of the electrical conductors may be formed as either a solid conductor or as a conductor that includes a plurality of conductive strands that are twisted together.

The twisted pair insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable tluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 105A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair 105 may utilize different insulation materials.

In certain embodiments, the insulation may be formed from multiple layers of one or a plurality of suitable materials. In other embodiments, the insulation may be formed from one or more layers of foamed material. As desired, different foaming levels may be utilized for different twisted pairs in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as a flame retardant materials, smoke suppressant materials, etc.

The jacket 120 may enclose the internal components of the cable 100, seal the cable 100 from the environment, and provide strength and structural support. The jacket 120 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 120 may be formed as a single layer or, alternatively, as multiple layers. In certain embodiments, the jacket 120 may be formed from one or more layers of foamed material. As desired, the jacket 120 can include flame retardant and/or smoke suppressant materials. Additionally, the jacket 120 may include a wide variety of suitable shapes and/or dimensions. For example, the jacket 120 may be formed to result in a round cable or a cable having an approximately circular cross-section; however, the jacket 120 and internal components may be formed to result in other desired shapes, such as an elliptical, oval, or rectangular shape. The jacket 120 may also have a wide variety of dimensions, such as any suitable or desirable outer diameter and/or any suitable or desirable wall thickness. In various embodiments, the jacket 120 can be characterized as an outer jacket, an outer sheath, a casing, a circumferential cover, or a shell.

An opening enclosed by the jacket 120 may be referred to as a cable core, and the twisted pairs 105A-D, the separator 110, and other cable components (e.g., one or more shield layers, etc.) may be disposed within the cable core. Although a single cable core is illustrated in FIG. 1A, a cable 100 may be formed to include multiple cable cores. In certain embodiments, a cable core may be filled with a gas such as air (as illustrated) or alternatively a gel, solid, powder, moisture absorbing material, water-swellable substance, dry filling compound, or foam material, for example in interstitial spaces between the twisted pairs 105A-D. In addition to the separator 110 and any shield layers, other elements can be added to the cable core as desired, for example one or more optical fibers, additional electrical conductors, additional twisted pairs, water absorbing materials, and/or strength members, depending upon application goals.

In certain embodiments, one or more shield layers may be incorporated into the cable 100. For example, as shown in FIG. 1A, an overall shield 115 or an external shield may be disposed between the jacket 120 and the twisted pairs 105A-D. In other words, the overall shield 115 may be wrapped around and/or encompass the collective group of twisted pairs 105A-D and the separator 10. As shown, the overall shield 115 may be positioned between the twisted pairs 105A-D and the outer jacket 120. In other embodiments, the overall shield 115 may be embedded into the outer jacket 120, incorporated into the outer jacket 120, or even positioned outside of the outer jacket 120. In other example embodiments, individual shields may be provided for each of the twisted pairs 105A-D. As desired, multiple shield layers may be provided, for example, individual shields and an overall shield. Each utilized shield layer may incorporate suitable shielding material, such as electrically conductive material, semi-conductive material, and/or dielectric shielding material in order to provide electrical shielding for one or more cable components. Further, in certain embodiments, the cable 120 may include a separate armor layer (e.g., a corrugated armor, etc.) for providing mechanical protection.

Various embodiments of the overall shield 115 illustrated in FIG. 1A are generally described herein; however, it will be appreciated that other shield layers (e.g., individual shield layers, etc.) may have similar constructions. In certain embodiments, a shield 115 may be formed from a single segment or portion that extends along a longitudinal length of the cable 100. In other embodiments, a shield 115 may be formed from a plurality of discrete segments or portions positioned adjacent to one another along a longitudinal length of the cable 100. In the event that discrete segments or portions are utilized, in certain embodiments, gaps or spaces may exist between adjacent segments or portions. In other embodiments, certain segments may overlap one another. For example, an overlap may be formed between segments positioned adjacent to one another along a longitudinal length of the cable.

As desired, a shield 115 (or a shield segment) may be formed with a wide variety of suitable constructions and/or utilizing a wide variety of suitable techniques. In certain embodiments, a foil shield or braided shield may be utilized. In other embodiments, a shield 115 may be formed from a combination of dielectric material and shielding material. For example, a shield may be formed from a suitable tape structure that includes one or more dielectric layers and one or more layers of shielding material. As desired, a shield 115 may be formed as a relatively continuous shield (e.g., a shield with a relatively continuous layer of electrically conductive material, shielding material, etc.) or as a discontinuous shield having a plurality of isolated patches of shielding material. For a discontinuous shield, a plurality of patches of shielding material may be incorporated into the shield 115, and gaps or spaces may be present between adjacent patches in a longitudinal direction. A wide variety of different patch patterns may be formed as desired in various embodiments, and a patch pattern may include a period or definite step. In other embodiments, patches may be formed in a random or pseudo-random manner. Additionally, individual patches may be separated from one another so that each patch is electrically isolated from the other patches. That is, the respective physical separations between the patches may impede the flow of electricity between adjacent patches. In certain embodiments, the physical separation of other patches may be formed by gaps or spaces, such as gaps of dielectric material or air gaps.

A shield 115 may be formed from a wide variety of suitable materials and/or combinations of materials. For example, a shield 115 may include any number of suitable dielectric and/or shielding materials. A wide variety of suitable dielectric materials may be utilized to form one or more dielectric layers or portions of a shield 115 including, but not limited to, paper, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, polytetrafluoroethylene, ethylene tetrafluoroethylene ("ETFE"), ethylene chlorotrifluoroethylene ("ECTFE"), etc.), one or more polyesters, polyimide, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or any other suitable material or combination of materials. As desired, one or more foamed materials may be utilized. Indeed, a dielectric layer may be filled, unfilled, foamed, un-foamed, homogeneous, or inhomogeneous and may or may not include one or more additives (e.g., flame retardant and/or smoke suppressant materials). Additionally, a dielectric layer may be formed with a wide variety of suitable thicknesses.

Additionally, each shielding layer or shielding portion of a shield 115 may be formed from a wide variety of suitable shielding materials and/or with a wide variety of suitable dimensions. As set forth above, a shielding layer may be formed as a relatively continuous layer or as a discontinuous layer having a plurality of isolated patches of shielding material. In certain embodiments, one or more electrically conductive materials may be utilized as shielding material including, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. In other embodiments, one or more semi-conductive materials may be utilized including, but not limited to, silicon, germanium, other elemental semiconductors, compound semiconductors, materials embedded with conductive particles, etc. In yet other embodiments, one or more dielectric shielding materials may be utilized including, but not limited to, barium ferrite, etc.

Additionally, a shielding layer and/or associated shielding material may be incorporated into a shield 115 utilizing a wide variety of suitable techniques and/or configurations. For example, shielding material may be formed on a base layer or a dielectric layer. In certain embodiments, a separate base dielectric layer and shielding layer may be bonded, adhered, or otherwise joined (e.g., glued, etc.) together to form a shield 115. In other embodiments, shielding material may be formed on a dielectric layer via any number of suitable techniques, such as the application of metallic ink or paint, liquid metal deposition, vapor deposition, welding, heat fusion, adherence of patches to the dielectric, or etching of patches from a metallic sheet. In certain embodiments, the shielding material can be over-coated with a dielectric layer or electrically insulating film, such as a polyester coating. In other embodiments, shielding material may be embedded into a base layer or dielectric layer. In yet other embodiments, a shield 115 may be formed (e.g., extruded, etc.) from a shielding material.

The components of a shield 115 (or segment of a shield) may include a wide variety of suitable dimensions, for example, any suitable lengths in the longitudinal direction, widths (i.e., a distance of the shield that will be wrapped around one or more twisted pairs 105A-D) and/or any suitable thicknesses. For example, shielding material may have any desired thickness, such as a thickness of about 0.5 mils (about 13 microns) or greater. In many applications, signal performance may benefit from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils.

Additionally, a wide variety of segment and/or patch lengths (e.g., lengths along a longitudinal direction of the cable 100) may be utilized. As desired, the dimensions of the segments and/or patches can be selected to provide electromagnetic shielding over a specific band of electromagnetic frequencies or above or below a designated frequency threshold. In certain embodiments, each patch of shielding material may have a length of about 0.05, 0.1, 0.2, 0.25, 0.3, 0.4, 0.5, 0.6, 0.7, 0.75, 0.8, 0.9, 1.0, 1.5, 2.0, 2.5, 3.0, 3.5, 4.0, 4.5, or 5.0 meters, a length included in a range between any two of the above values, or a length included in a range bounded on either a minimum or maximum end by one of the above values. Additionally, a wide variety of suitable gap distances or isolation gaps may be provided between adjacent patches. For example, the isolation spaces can have a length of about 0.5, 1.0, 1.5, 2.0, 2.5, 3.0, 3.5, 4, 5, 6, 7, 8, 9, or 10 mm, a length included in a range between any two of the above values, or a length included in a range bounded on either a minimum or maximum end by one of the above values.

In certain embodiments, a shielding layer may include shielding material or patches of shielding material that extend substantially across a width dimension of an underlying dielectric layer. In other embodiments, shielding material may be formed with a width that is different than the width of an underlying base layer or portion of the base layer. In yet other embodiments, a plurality of discontinuous patches of shielding material may be formed across or within a widthwise dimension, and widthwise gaps may be present between each of the plurality of patches. Indeed, any section or patch of shielding material may have any suitable width and a wide variety of different configurations of shielding material may be formed in a widthwise dimension. Additionally, patches of shielding material may have a wide variety of different shapes and/or orientations. For example, the patches may have a rectangular, trapezoidal, approximately triangular, or parallelogram shape. In certain embodiments, patches may be formed to be approximately perpendicular (e.g., square or rectangular segments and/or patches) to the longitudinal axis of twisted pairs 105A-D incorporated into a cable. In other embodiments, the patches may have a spiral direction that is opposite the twist direction of one or more pairs. That is, if the twisted pair(s) 105A-D are twisted in a clockwise direction, then the segments and/or patches may spiral in a counterclockwise direction. If the twisted pair(s) are twisted in a counterclockwise direction, then the conductive patches may spiral in a clockwise direction. In certain embodiments, the opposite directions may provide an enhanced level of shielding performance. In other embodiments, patches may have a spiral direction that is the same as the twist direction of one or more pairs.

With continued reference to FIG. 1A, a separator 110 or filler may be incorporated into the cable 100 and positioned between two or more of the twisted pairs 105A-D. In certain embodiments, the separator 110 may be configured to orient and/or position one or more of the twisted pairs 105A-D. The orientation of the twisted pairs 105A-D relative to one another may provide beneficial signal performance. The separator 110 may include a central portion 125 and a plurality of projections 130A-D may extend from the central portion 125 with each projection (generally referred to as projection 130) extending between an adjacent set of twisted pairs. As explained in greater detail below, the central portion 125 and the projections 130A-D may be formed from a wide variety of suitable materials, may have a wide variety of suitable dimensions, and may be arranged in a wide variety of suitable configurations.

Projections 130A-D may extend from the central portion 125 in any number of suitable directions. As shown in FIG. 1A, in certain embodiments, projections 130A-D may extend from the central portion 125 in four different directions, such as four directions configured at quadrantile angles (e.g., up, down, left, and right directions). FIG. 1A illustrates a cross-sectional view of an example cable 100, and only a single projection respectively extending in each of four directions is illustrated. However, as illustrated in FIGS. 2A-2H and explained in greater detail below, a plurality of discrete projections may extend in any given direction with longitudinal spaces or gaps present between adjacent projections. Any number of longitudinally spaced projections may extend from the central portion 125 in a given direction. Additionally, the projections may have a wide variety of suitable dimensions, and a wide variety of suitable longitudinal spaces or gaps may be present between projections. In other embodiments, such as embodiments, including less than or more than four twisted pairs, projections may extend in any other suitable combination of directions.

According to an aspect of the disclosure, at any given location along a longitudinal length of the separator 110, projections will not extend between all of the adjacent sets of twisted pairs 105A-D. In other words, given the four pair cable 100 of FIG. 1A, respective projections may extend in one, two, or three directions between one, two, or three sets of adjacent twisted pairs 105A-D at any given longitudinal location; however, projections will not extend between all four adjacent sets of twisted pairs 105A-D. In this regard, the separator 110 may function as a cross-filler that includes projections or fins that provide separation between each adjacent set of twisted pairs along a longitudinal length. However, at any given location along the longitudinal length, projections may not extend between all of the twisted pairs. As a result, a cross-filler separator may be formed that includes less material than conventional cross-fillers, thereby reducing material costs and/or enhancing the flexibility of the separator. Similar arrangements of projections may be utilized for cables or cable components with more or less than four twisted pairs.

In certain embodiments, respective sets of one or more projections may be longitudinally spaced along the central portion 125, and each adjacent set of projections may extend from the spine in different sets of directions. In other words, the angles of extension for the longitudinally spaced projections may be alternated or otherwise varied. For example, a first set of one or more projection may extend from the central portion 125 at a first location located along the longitudinal length of the separator 100. The first set of projections may extend in a first respective set of directions with each projection extending in a different direction between a respective set of adjacent twisted pairs. A second set of one or more projections may then extend from the central portion 125 at a second location along a longitudinal length of the separator 100. The second location may be situated adjacent to the first location along the longitudinal length of the separator 100. In other words, even though a longitudinal gap may optionally be present between the first and second locations, no other sets of projections extend from the central portion 125 between the first and second locations. Additionally, the second set of one or more projections may extend from the central portion 125 in a second respective set of directions that is different than the first set of directions. In other words, at least one projection included in the second set of projections may extend in a different direction than any of the projections included in the first set of projections. A third set of one or more projections may then extend from the central portion 125 at a third location positioned on an opposite side of the second location, and the third set of one or more projections may extend in a third set of one or more directions that is different than the second set of directions. Any other number of sets of projections may extend from the central portion 125 along a longitudinal length of the separator 100 in a similar manner.

Figure 2A:
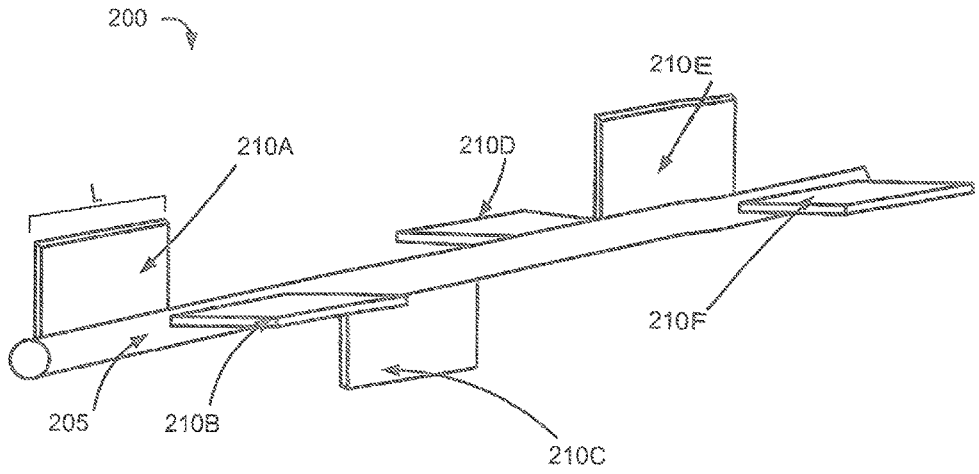
FIGS. 2A-2H are perspective views of example separators that include a plurality of projections that extend from a spine or central portion in different directions at various locations along a longitudinal length, according to illustrative embodiments of the disclosure.
Figure 2B:
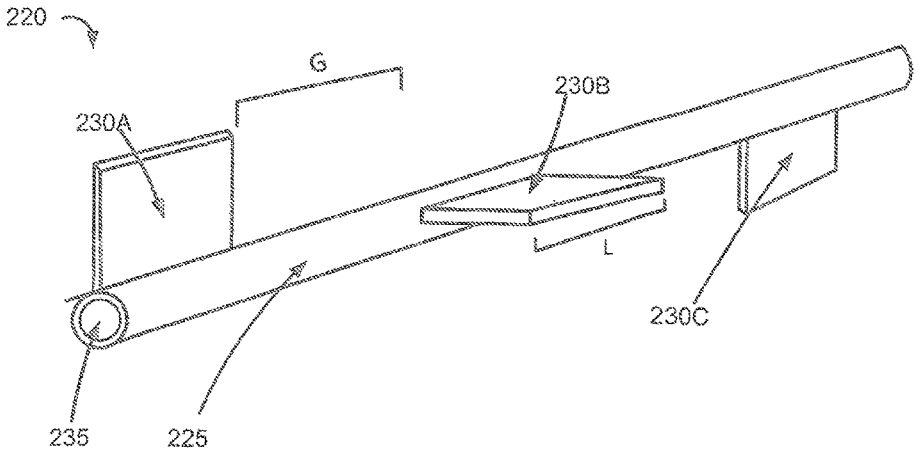

A wide variety of suitable configurations of projections may be utilized as desired in various embodiments. A few example configurations are illustrated in FIGS. 2A-2H and described in greater detail below. Additionally, any suitable number of projections may extend from the central portion 125 at a given longitudinally spaced location. In certain embodiments, as illustrated in FIGS. 2A and 2B, a single projection may extend from each longitudinally spaced location, and the projections may alternate directions of extension at approximately ninety degree (90°) angles. In other embodiments, single projections may extend from each longitudinally spaced location in any other suitable pattern. For example, a first projection may extend in an upward direction, a second projection may extend in a downward direction, a third projection may extend in a left direction, a fourth projection may extend in a right direction, and then the pattern may repeat. A wide variety of patterns may be utilized to vary the directions of projection. In yet other embodiments, the direction of projection may be varied in a random or pseudo-random manner.

Figure 2C:
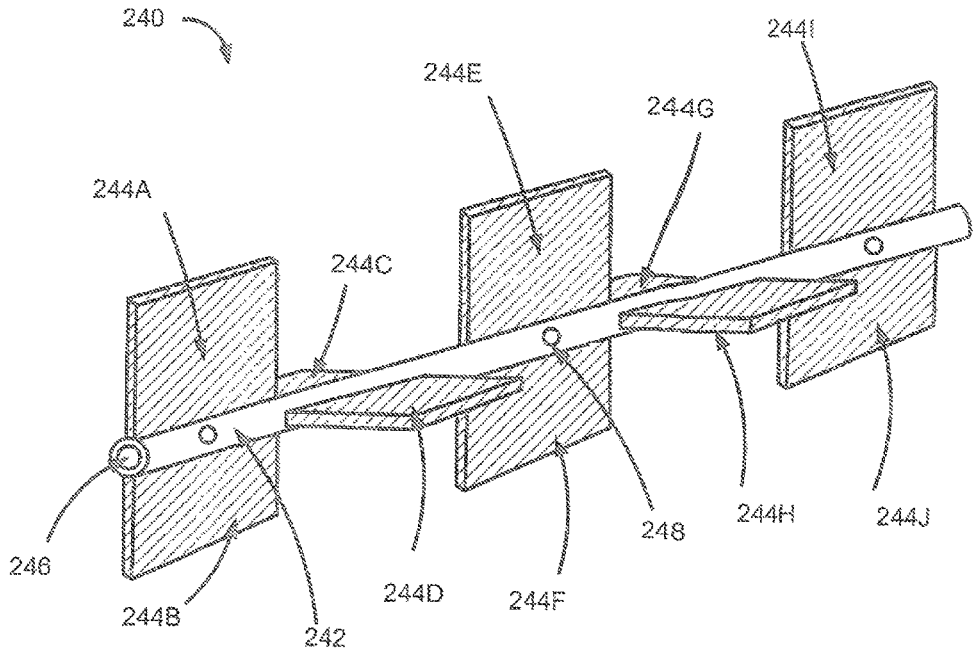
Figure 2D:
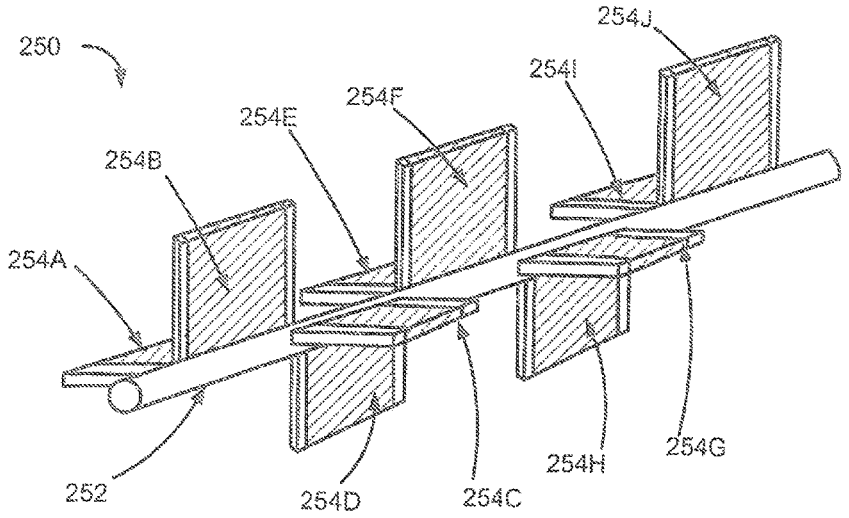

In other embodiments, as illustrated in FIG. 2C, two projections may extend from each longitudinally spaced location in opposite directions from the central portion 125. The directions of extension may then alternate by approximately one hundred and eighty degrees (180°) between adjacent spaced locations. For example, projections may alternate between up/down and left/right orientations. In other embodiments, two projections may extend from each longitudinally spaced location with an approximately ninety degree (90°) angle between the two projections. The directions of extension for the two projections may then be varied between adjacent longitudinally spaced locations. For example, as illustrated in FIG. 2D, projections may alternate between left/up and right/down orientations. As another example, the directions of extension may be rotated by approximately ninety degrees (90°) at each longitudinally spaced location. In other words, projections may rotate between left/up, up/right, right/down, and down/left orientations. Other suitable configurations of two projections may be utilized as desired. In various embodiments, the directions of projection may be varied in accordance with a desired pattern or, alternatively, in a random or pseudo-random manner.

Figure 2E:
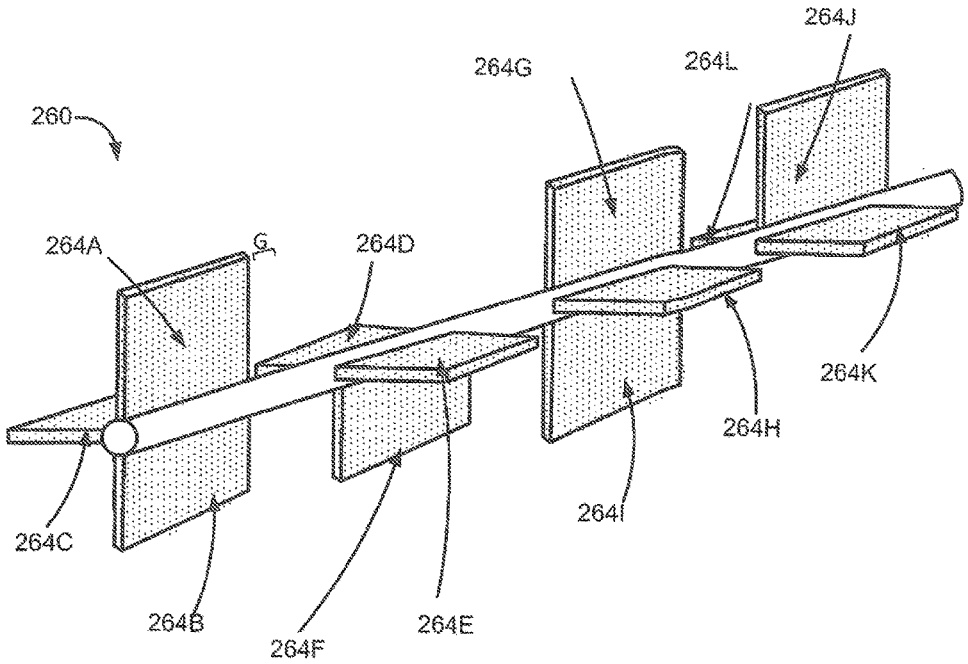
Figure 2F:
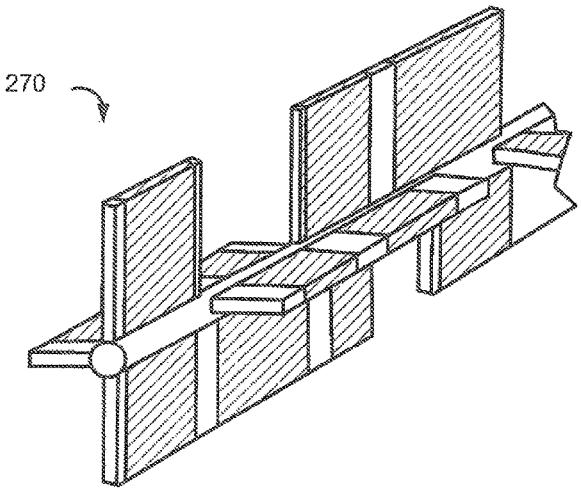

In yet other embodiments, three projections may extend from each longitudinally spaced location, and a projection that is not present may be alternated or otherwise varied along a longitudinal length. For example, as shown in FIGS. 2E and 2F, a projection that is not present may be alternated at approximately ninety degree (90°) angles at adjacent longitudinally spaced locations. In other embodiments, a single projection that is not present may be alternated in any other suitable pattern or, alternatively, in a random or pseudo-random manner. Although a few examples of alternating projections are described above, a wide variety of other suitable configurations or projections may be utilized as desired.

Additionally, in certain embodiments, longitudinally spaced locations at which projections 130A-D extend may be situated immediately adjacent to one another in an end to end manner along a longitudinal length of a separator 110. As illustrated in FIG. 2F, in certain embodiments, individual projections may longitudinally extend through a plurality of longitudinally spaced locations as other projections (i.e., one or more projections extending in different directions) are omitted or not present at various spaced locations. In other embodiments, such as the example embodiments illustrated in FIGS. 2B and 2G, a suitable gap or longitudinal space may be present between at least two adjacent longitudinally spaced locations. In other words, a first set of one or more projections may extend from a first spaced location having a first longitudinal length. A second set of one or more projections may extend from a second spaced location having a second longitudinal length. Additionally, a longitudinal gap may be present along the separator 110 between the first and second spaced locations. A wide variety of suitable longitudinal gaps may be utilized as desired in various embodiments including, but not limited to, gaps of approximately 10, 20, 25, 30, 40, 50, 60, 70, 75, 80, 90, 100, 110, 120, 130, 140, 150, 160, 170, 180, 190, or 200 cm, a gap incorporated into a range between any two of the above values, or a gap incorporated into a range bounded on either a minimum or maximum end by one of the above values. Additionally, in certain embodiments, various gaps positioned along a longitudinal length of the separator 110 may have longitudinal lengths or sizes that are approximately equal. In other embodiments, the longitudinal lengths of gaps may be varied in accordance with any desired pattern or, alternatively, in a random or pseudo-random manner.

As set forth above, the separator 110 may include a central portion 125 and a plurality of projections 130A-D that extend from the central portion 125 between various sets of adjacent twisted pairs. The central portion 125 (or spine 125) may be formed with a wide variety of suitable dimensions and/or constructions. For example, the spine 125 may be formed with any suitable cross-sectional shape. As shown in FIG. 1A, the spine 125 may have an approximately square cross-sectional shape. In other embodiments, the spine 125 may be formed with a circular, elliptical, rectangular, approximately rectangular (e.g., rectangular with rounded corners, etc.) square, triangular, hexagonal, octagonal, or any other suitable cross-sectional shape. Additionally, the spine 125 may be formed with a wide variety of suitable cross-sectional areas. For example, the spine 125 may have a cross-sectional area of approximately $7.85\times10^{-5}$, $3.14\times10^{-4}$, $1.256\times10^{-3}$, $1.962\times10^{-3}$, $2.826\times10^{-3}$, $5.02\times10^{-3}$, $7.85\times10^{-3}$, $1.76\times10^{-2}$, or $3.14\times10^{-2}$ square inches, a cross-sectional area included in a range between any two of the above values, or a cross-sectional area included in a range bounded on either a minimum or maximum end by one of the above values. As another example, the spine 125 may have a diameter of approximately 0.01, 0.02, 0.03, 0.04, 0.05, 0.06, 0.07, 0.08, 0.09, 0.10, 0.12, 0.14, 0.15, 0.16, 0.18, or 0.20 inches, a diameter included in a range between any two of the above values (e.g., a diameter between approximately 0.01 and approximately 0.10 inches, etc.), or a diameter included in a range bounded on either a minimum or maximum end by one of the above values.

The spine 125 may also be formed with a wide variety of suitable lengths. In certain embodiments, the spine 125 may be formed from a single segment or portion that extends along a longitudinal length of the cable 100. In other embodiments, the spine 125 may be formed from a plurality of discrete segments or portions positioned adjacent to one another along a longitudinal length of the cable 100, such as a plurality of segments that are arranged end to end. In the event that discrete segments or portions are utilized, in certain embodiments, gaps or spaces may exist between adjacent segments or portions. In other embodiments, certain segments may overlap one another. For example, an overlap may be formed between segments positioned adjacent to one another along a longitudinal length of the cable. Regardless of whether a spine 125 is formed from one or a plurality of segments, as desired in various embodiments, one or more dimensions of the spine 125 may be varied along a longitudinal direction. For example, the spine 130 may include various portions with different diameters, cross-sectional shapes, and/or other dimensions. Dimensional variations may be arranged in accordance with any desirable pattern or, alternatively, in a random or pseudo-random manner.

The spine 125 may also be formed from a wide variety of suitable materials and/or combinations of materials including, but not limited to, dielectric materials (e.g., polymeric materials, etc.), conductive materials, semi-conductive materials, etc. For example, the spine 125 may be formed from paper, metals, alloys, various plastics, one or more polymeric materials, one or more polyolefins (e.g., polyethylene, polypropylene, etc.), one or more tluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, one or more semi-conductive materials (e.g., materials that incorporate carbon, etc.), one or more dielectric shielding materials (e.g., barium ferrite, etc.) or any other suitable material or combination of materials. In certain embodiments, the spine 125 may have a relatively flexible body. As desired, the spine 125 may be filled, unfilled, foamed, un-foamed, homogeneous, or inhomogeneous and may or may not include additives (e.g., flame retardant materials, smoke suppressant materials, strength members, water swallable materials, water blocking materials, etc.). In certain embodiments, as shown in FIGS. 2B and 2C, the spine 125 may include one or more longitudinal channels or cavities. For example, one or more longitudinal channels may facilitate temperature normalization and/or cooling within the cable. As another example, one or more channels and/or cavities may be provided and other suitable cable components may be positioned with the channels and/or cavities including, but not limited to, transmission media (e.g., one or more optical fibers), flame retardant material, smoke suppressant material, etc. As desired, any number of secondary channels may extend between a longitudinal channel and an outer surface of the separator 100.

In certain embodiments, the spine 125 may be formed without incorporating shielding material. For example, the separator 125 may be formed from suitable dielectric materials. In other embodiments, electromagnetic shielding material may be incorporated into the spine 125. A wide variety of different types of materials may be utilized to provide shielding, such as electrically conductive material, semi-conductive material, and/or dielectric shielding material. A few examples of suitable materials are described in greater detail above with reference to the external shield layer 115 and are equally applicable to the separator 110. In certain embodiments, shielding material may be formed on one or more surfaces of the spine 125. For example, shielding material may be formed on an external surface of the spine 125 and/or within one or more channels. In other embodiments, shielding material may be embedded within the body of the spine 125. In yet other embodiments, a spine 125 may be formed from one or more suitable shielding materials.

For a spine 125 formed from a plurality of discrete segments, the various portions or segments of the spine 125 may include a wide variety of different lengths and/or sizes. In certain embodiments, spine portions may have a common length. In other embodiments, portions of the spine 125 may have varying lengths. These varying lengths may follow an established pattern or, alternatively, may be incorporated into the cable at random. Additionally, in certain embodiments, each segment or portion of the spine 125 may be formed from similar materials. In other embodiments, a spine 125 may make use of alternating materials in adjacent portions (whether or not a gap is formed between adjacent portions). For example, a first portion or segment of the spine 125 may be formed from a first set of one or more materials, and a second portion or segment of the spine 125 may be formed from a second set of one or more materials. As one example, a relatively flexible material may be utilized in every other portion of a spine 125. As another example, relatively expensive flame retardant material may be selectively incorporated into desired portions of a spine 125. In this regard, material costs may be reduced while still providing adequate flame retardant qualities.

A projection 130, prong, fin, or extension may include any suitable projection or other component that radially extends from a spine or central portion 125. In certain embodiments, each projection 130 may extend between an adjacent set of twisted pairs, thereby providing separation between the twisted pairs that may enhance the electrical performance of a cable or cable component. A projection 130 may be formed with a wide variety of suitable dimensions, such as a wide variety of suitable cross-sectional shapes, cross-sectional areas, thicknesses, distances of projection (i.e., length of projection from the central portion 125), and/or longitudinal lengths. For purposes of this disclosure, the cross-sectional shape of a projection 130 may refer to the shape of a projection 130 along a longitudinal length of the separator 100. In certain embodiments, as shown in FIGS. 2A-2G, a projection 130 may be formed with a rectangular or approximately rectangular cross-sectional shape. In other embodiments, a projection 130 may be formed with a semi-circular, square, approximately square (e.g., square with rounded corners, etc.), parallelogram, trapezoidal, triangular, approximately triangular, spike, or any other suitable cross-sectional shape. A few example cross-sectional shapes that may be utilized for a projection 130 are described in greater detail below with reference to FIGS. 3A-3F.

Additionally, a projection 130 may be formed with a wide variety of suitable longitudinal lengths (e.g., lengths along the longitudinal dimension of the separator 100). For example, a projection may have a longitudinal length of approximately 5, 10, 15, 20, 25, 30, 35, 40, 45, 50, 55, 60, 65, 70, 75, 80, 85, 90 or 100 cm, a length incorporated into a range between any two of the above values, or a length incorporated into a range bounded on either a minimum or maximum end by one of the above values.

Figure 1B:
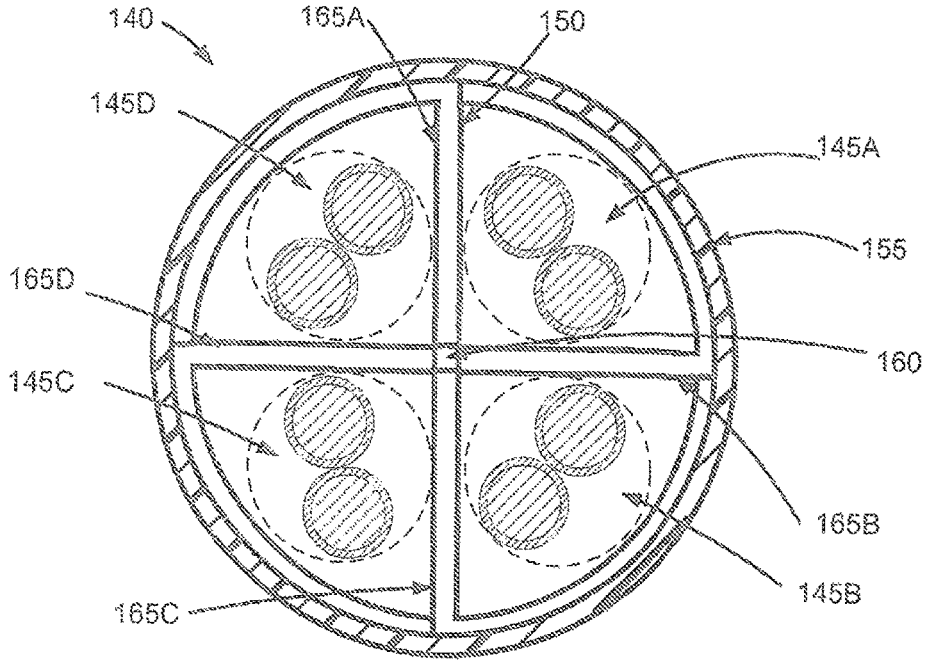

A projection 130 may also be formed with a wide variety of suitable distances of projection. In other words, a projection 130 may extend or project any suitable distance from the central portion 125. In certain embodiments, a projection 130 may have a distance of extension that is less than or approximately equal to the diameter of a twisted pair 105 (e.g., the combined diameters of the two conductors of a twisted pair 105). For example, a projection 130 may have a distance of projection that is approximately 0.25, 0.3, 0.35, 0.4, 0.45, 0.5, 0.55, 0.6, 0.65, 0.7, 0.75, 0.8, 0.85, 0.9, or 1.0 times the diameter of a twisted pair 105, a distance of projection included in a range between any two of the above values, or a distance of projection included in a range bounded on either a minimum or maximum end by one of the above values. In other embodiments, a projection 130 may have a distance of projection that is approximately equal to a radius of a cable core. In other words, the projection 130 may extend approximately between the central portion 125 and an adjacent wrap layer (e.g., a shield layer 115, a jacket 120, etc.). In other embodiments, as shown in FIG. 1B, a projection 130 may have a distance of projection that permits the projection 130 to extend beyond an outer periphery of the twisted pairs 105A-D (e.g., the space occupied by the twisted pairs 105A-D in a cable core). As desired, an extending portion of a projection 130 may be curled or wrapped around the outer periphery of the twisted pairs 105A-D. In this regard, the projection 130 may provide separation between the twisted pairs 105A-D and one or more other cable components, such as a shield layer 115 or an outer jacket 120. In various example embodiments, a projection 130 may have a distance of projection of approximately 0.03, 0.04, 0.05, 0.07, 0.08, 0.1, 0.2, 0.3, 0.4, 0.5, 0.6, 0.7, or 0.8 inches, a distance of projection included in a range between any two of the above values (e.g., a length between approximately 0.03 and approximately 0.7 inches, etc.), or a distance of projection included in a range bounded on either a minimum or maximum end by one of the above values.

Additionally, the distances of projection discussed above refer to a projection 130 that extends in a single direction from the central portion 125. In certain embodiments, a projection 130 may extend through the central portion 125 and in multiple directions from the central portion 125 (e.g., in both a north and south direction, in both an east and west direction, etc.). In these embodiments, a projection 130 may be formed with a length that accounts for both directions of extension and the cross-sectional area of the central portion 125.

A projection 130 may also be formed with a wide variety of suitable thicknesses. For example, a projection 130 may have a thickness of approximately 0.003, 0.005, 0.007, 0.01, 0.015, 0.02, 0.025, 0.03, 0.04, 0.05, 0.06, 0.07, 0.08, 0.09, or 0.1 inches, a thickness included in a range between any two of the above values (e.g., a thickness between approximately 0.003 and approximately 0.08 inches, etc.), or a thickness included in a range bounded on either a minimum or maximum end by one of the above values. In certain embodiments, a thickness, diameter, or cross-sectional area of projection 130 may correspond to an amount of separation distance provided by the projection 130. For example, when a projection 130 is positioned between or extends between two adjacent twisted pairs, the thickness of the projection 130 may define or correlate to a minimum separation distance between the adjacent pairs. As another example, if a projection 130 extends beyond and is wrapped around an outer periphery of the twisted pairs 105A-D, then the thickness of the projection 130 may define or correlate to a minimum separation distance between the twisted pairs 105A-D and an adjacent wrap layer (e.g., a shield layer 115, a jacket 120, etc.). In certain embodiments, a projection 130 may have a relatively uniform thickness. In other embodiments, the thickness of a projection 130 may vary. For example the thickness of the projection 130 may taper as the projection 130 extends away from the central portion 125. Further, in certain embodiments, each projection 130 may be formed with substantially similar dimensions (e.g., cross-sectional shape, thickness, distance of projection, etc.). In other embodiments, at least two projections may be formed with different dimensions.

A projection 130 may be formed from a wide variety of suitable materials and/or combinations of materials including, but not limited to, dielectric materials (e.g., polymeric materials, etc.), conductive materials, semi-conductive materials, etc. For example, a projection 130 may be formed from paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZ") material, etc.), polyurethane, neoprene, cholorosulphonated polyethylene, flame retardant PVC, low temperature oil resistant PVC, flame retardant polyurethane, flexible PVC, one or more semi-conductive materials (e.g., materials that incorporate carbon, etc.), one or more dielectric shielding materials (e.g., barium ferrite, etc.) or any other suitable material or combination of materials. Additionally, in various embodiments, a projection 130 may be formed with any number of suitable layers, such as one or a plurality of layers. As desired, a projection 130 may be foamed, unfoamed, homogeneous, or inhomogeneous and may or may not include additives (e.g., flame retardant materials, smoke suppressant materials, shielding materials, water swallable materials, water blocking materials, etc.). A few example material and/or layer constructions that may be utilized for a projection 130 are discussed in greater detail below with reference FIGS. 4A-4E.

Figure 2G:
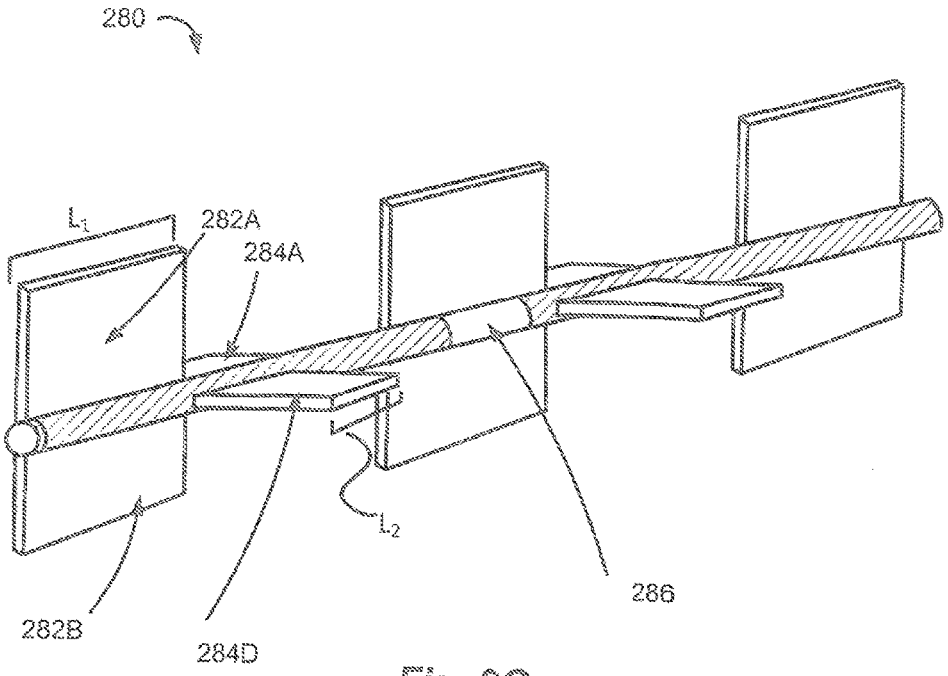
Figure 2H:
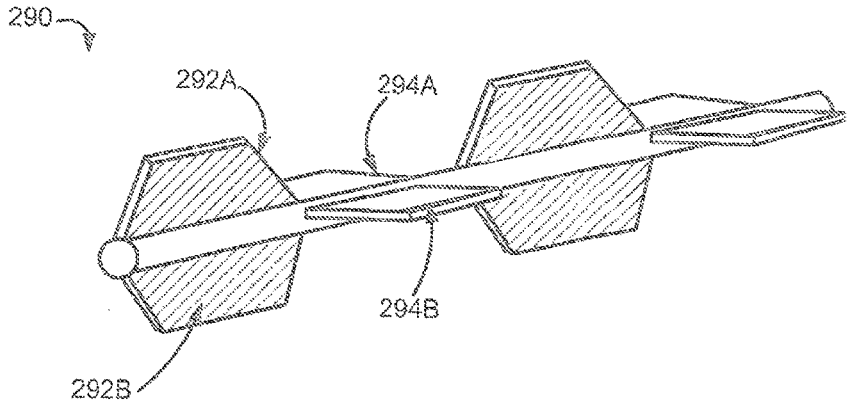

In certain embodiments, each of the projections 130A-D may be formed with similar dimensions and/or material constructions. In other embodiments, at least two projections may be formed with different dimensions (e.g., diameters, cross-sectional shapes, etc.) and/or material constructions. For example, as shown in FIG. 2G and explained in greater detail below, different sets of projections may be formed with different longitudinal lengths. As another example, as shown in FIG. 2H and explained in greater detail below, different sets of projections may be formed with different cross-sectional shapes. With continued reference to FIG. 2H, in certain embodiments, a first portion of the projections may be formed from dielectric materials while a second portion of the projections may be formed from or incorporate shielding material. As yet another example, a first portion of the projections may be formed from or incorporate flame retardant materials while a second portion of the projections may be formed from other materials. As desired, projections having different dimensions and/or material constructions may be arranged in accordance with any desirable pattern or, alternatively, in a random or pseudo-random manner.

A wide variety of suitable methods and/or techniques may be utilized to form a separator 110 as desired in various embodiments. In certain embodiments, the separator 110 may be extruded, molded, or otherwise formed with a predetermined shape. For example, a separator 110 may be extruded or otherwise formed to include both a central portion 125 and a plurality of projections 130A-D. In other embodiments, a central portion 125 and a plurality of projections 130A-D may be separately formed, and then the components of the separator 110 may be joined or otherwise attached together via adhesive, bonding, or physical attachment elements (e.g., male and female connectors, pins, etc.). In other embodiments, a separator 110 may be formed from one or more tapes that are folded into a desired shape. For example, a relatively flat tape that includes any number of dielectric, shielding (e.g., electrically conductive, etc.), and/or other layers may be provided. In certain embodiments, the tape may then be folded into a cross-shaped or other suitable shape separator via one or more dies or other suitable components. As desired, prior to, during, or following the folding, the tape may have certain portions removed in order to account for alternating or varying projections. In other embodiments, as explained in U.S. patent application Ser. No. 15/345,775 which is incorporated by reference herein in its entirety, a tape may be twisted in order to form a separator 110 with alternating or varied projections. A wide variety of other suitable construction techniques and/or materials may be utilized to form a separator 110 as desired.

Regardless of the construction or materials utilized, in certain embodiments, the separator 110 may be formed with a predetermined configuration of projections 130A-D. In other words, the projections 130A-D are arranged in a desired orientation (e.g., directions of extension, etc.) when the separator 110 is formed. In other embodiments, a separator 110 may be formed with projections 130A-D in a first configuration, and then the central portion 125 of the separator 110 may be longitudinally twisted in order to reorient the projections 130A-D into a desired configuration. For example, a separator 110 may be formed with projections 130A-D extending in a single direction from a central portion 125. As another example, a separator 110 may be formed with projections 130A-D extending in two directions from the central portion 125 (e.g., the central portion 125 is positioned between projections 130A-D extending in opposite directions). When the central portion 125 of the separator 110 is twisted, the projections 130A-D may be reoriented. In other words, as a result of the twisting, the projections 130A-D may project from the central portion 125 in a plurality of various directions relative to their pre-twisted positions.

As one example, prior to being twisted, a separator 110 may include longitudinally spaced projections 130A-D that each extend in the same direction. The central portion 125 may then be twisted with a suitable pitch to result in the projections extending in directions that alternate by approximately ninety degrees (90°) along the longitudinal length of the separator 110. As another example, prior to being twisted a separator 110 may include projections 130A-D that extend in opposite directions from the central portion 125 at a plurality of longitudinally spaced locations. The central portion 125 may then be twisted with a suitable pitch to result in projections that alternate by approximately 180 degrees (180°) along the longitudinal length of the separator 110. A wide variety of other configurations may be obtained as a result of longitudinally twisted a separator 110.

A wide variety of suitable methods and/or techniques may be utilized to twist the separator 110 as desired in various embodiments. In certain embodiments, the separator 110 may be fed from one or more suitable sources (e.g., reels, spools, etc.) and connected downstream to one or more suitable twisting devices and/or machines that impart a twist on the separator 110 while back tension is supplied by the source(s) and/or any number of intermediary devices. The separator 110 may be twisted in a suitable direction "T", such as a clockwise or a counter-clockwise direction, as desired in various embodiments. Additionally, the separator 110 may be longitudinally twisted with any desired twist rate and/or twist lay. In certain embodiments, the twist rate and/or twist lay may be based at least in part upon the number of projections extending from the central portion 125 at various cross-sectional locations. In other words, the twist rate and/or lay may be determined such that various projections 130A-D extend from the central portion 125 in desired directions or at desired angles.

As set forth above, in certain embodiments, a separator 110 may include or incorporate electromagnetic shielding material. Accordingly, the separator 110 may provide shielding for one or more of the twisted pairs 105A-D. For example, a shielding layer may be incorporated into the central portion 125 (e.g., on one or more surfaces of the central portion 125, sandwiched between two other layers of the central portion 125, etc.) and/or into any number of the projections 130A-D (e.g., on one or more surfaces of a projection 130, sandwiched between two other layers of a projection 130, etc.). As another example, the central portion 125 and/or any number of projections 130A-D may be formed from shielding material(s). As yet another example, shielding material may be embedded into the central portion 125 and/or any number of projections 130A-D. A wide variety of different types of materials may be utilized to provide shielding, such as electrically conductive material, semi-conductive material, and/or dielectric shielding material. A few examples of suitable materials are described in greater detail above with respect to shielding layer 115 and are equally applicable to shielding material incorporated into a separator 110. Additionally, in certain embodiments, the separator 110 may include shielding material and/or one or more shielding layers that are continuous along the longitudinal length of the separator 110. In other embodiments, the separator 110 may include discontinuous or discrete sections or portions of shielding material, such as discrete patches of shielding material incorporated into the central portion 125 and/or any number of projections 130A-D. As desired, patches of shielding material may be formed in accordance with a wide variety of suitable configurations and/or dimensions, such as any of the configurations and/or dimensions discussed above with reference to the overall shield layer 115.

Turning now to FIG. 1B, a cross-sectional view of another example twisted pair cable incorporating a separator that includes a plurality of projections that extend in different directions at various locations along a longitudinal length is illustrated. The cable 140 of FIG. 1B may include components that are similar to the cable 100 illustrated and described above with reference to FIG. 1A. Accordingly, the cable 140 may include a plurality of twisted pairs 145A-D disposed in a cable core, a separator 150 positioned between the plurality of twisted pairs 145A-D, and, a jacket 155 formed around the twisted pairs 145A-D and the separator 150. Each of these components may be similar to those discussed above with reference to FIG. 1A.

Similar to the separator 110 illustrated in FIG. 1A, the separator 150 illustrated in FIG. 1B may include a central portion 160 and a plurality of projections 165A-D may extend from the central portion 160. According to an aspect of the disclosure, each of the projections 165A-D may extend between an adjacent set of twisted pairs; however, at any given location along a longitudinal length of the separator 150, a respective projection will not extend between each adjacent set of twisted pairs. Additionally in contrast to the cable 100 of FIG. 1A, one or more of the projections 165A-D may extend from the central portion 160 between a desired set of twisted pairs and beyond an outer periphery or circumference defined by the collective group of twisted pairs 145A-D. In other words, a projection (generally referred to as projection 165) may be formed with a suitable distance of projection that permits the projection 165 to extend beyond an outer periphery of the twisted pairs 145A-D. As shown, each of the illustrated projections 165A-D may extend beyond an outer periphery of the twisted pairs 145A-D; however, in other embodiments, a first portion of the projections may extend beyond the outer periphery while a second portion of the projections do not extend beyond the outer periphery.

In certain embodiments, the portion of a projection 165 that extends beyond an outer periphery of the twisted pairs 145A-D may be curled or wrapped around the outer periphery of the twisted pairs 145A-D. In this regard, the extending portion may form a wrap or shield layer around the outer periphery of the twisted pairs 145A-D. An extending portion may extend any desired distance beyond the outer periphery. As shown in FIG. 1B, each extending portion may extend a distance that is approximately one fourth of the outer circumference of the twisted pairs 145A-D. In other embodiments, one or more extending portions may extend any other suitable distance. As desired, an extending portion may overlap another extending portion (e.g., an adjacent extending portion in the event that the sections extend an non-perpendicular angles from a continuous section 110) or in some instances itself (e.g., if an extending portion extends all the way around the outer circumference). When an overlap is formed, an extending portion may be optionally adhered, bonded, mechanically fastened, or otherwise affixed to an underlying layer. As a result of including one or more projections 165 that extend beyond an outer periphery of the twisted pairs 145A-D, the tape 100 may function as both a separator and as at least a partial outer shield layer. In certain embodiments, one or more projections 165 may also provide desired separation between the twisted pairs 145A-D and the jacket 155. As a result, additional separation may be provided between the twisted pairs 145A-D and any number of adjacent cables, thereby reducing alien crosstalk.

As desired in various embodiments, a wide variety of other materials may be incorporated into a cable, such as the cables 100, 140 illustrated in FIGS. 1A and 1B. For example, as set forth above, a cable may include any number of conductors, twisted pairs, optical fibers, and/or other transmission media. As another example, one or more respective dielectric films or other suitable components may be positioned between the individual conductors of one or more of the twisted pairs. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), flame retardants, flame suppressants or extinguishants, gels, and/or other materials. The cables 100, 140 illustrated in FIGS. 1A and 1B are provided by way of example only. Embodiments of the disclosure contemplate a wide variety of other cables and cable constructions. These other cables may include more or less components than the cables 100, 140 illustrated in FIGS. 1A and 1B. Additionally, certain components may have different dimensions and/or materials than the components illustrated in FIGS. 1A and 1B. Further, although FIGS. 1A and 1B illustrate jacketed cables, the example separators discussed herein may also be utilized in any number of unjacketed cable components, such as unjacketed cable components that are incorporated into larger cables.

Example Separator Structures

As set forth above, a wide variety of suitable separators may be utilized as desired in various embodiments of the disclosure. Additionally, various separators may include a wide variety of dimensions, configurations of projections, layers, and/or materials. FIGS. 2A-2H illustrate perspective views of a few example separators that may be utilized in accordance with various embodiments of the disclosure. Each of these figures is discussed in greater detail below.

Turning now to FIG. 2A, a perspective view of a first example separator 200 is illustrated. The separator 200 may include a central portion 205, and a plurality of longitudinally spaced projections 210A-F may extend from the central portion 205 along its longitudinal length. As shown in FIG. 2A, a single projection may extend from the central portion 205 at each of the longitudinally spaced locations. Additionally, the projections 210A-F may alternate in their directions of projection from the central portion 205 by approximately ninety degrees (90°) at each longitudinally spaced location. As shown, the projections 210A-F may alternate in a clockwise direction; however, in other embodiments, the projections 210A-F may alternate in a counter-clockwise direction. In yet other embodiments, the directions of projections may be alternated or varied in any other suitable patter or, alternatively, in a random or pseudo-random manner.

As set forth above, each of the projections (generally referred to as projection 210) may have a wide variety of suitable dimensions, such as any desirable cross-sectional shape, longitudinal length "L", thickness, and/or distance of projection from the central portion 205. As shown, each projection 210 may have a rectangular cross-sectional shape. Other suitable cross-sectional shapes, such as any of the cross-sectional shapes discussed below with reference to FIGS. 3A-F, may be utilized as desired. Additionally, the various components of the separator 200 may be formed from a wide variety of suitable materials and/or combinations of materials, such as any of the dielectric and/or shielding materials discussed above with reference to FIG. 1A.

FIG. 2B illustrates a perspective view of a second example separator 220 that may be utilized in accordance with various embodiments of the disclosure. Similar to the separator 200 of FIG. 2A, the separator 220 may include a central portion 225, and a plurality of longitudinally spaced projections 230A-C may extend from the central portion 225 along its longitudinal length. In certain embodiments, one or more longitudinal channels 235 may be incorporated into the central portion 225. As shown, the projections 230A-C may alternate in their directions of projection from the central portion 225 by approximately ninety degrees (90°) at each of a plurality of spaced longitudinally spaced location. In other embodiments, the directions of projections may be varied in other suitable patterns or in a random or pseudo-random manner. Additionally, similar to the separator 200 of FIG. 2B, each of the projections (generally referred to as projection 230) may have a wide variety of suitable dimensions, such as any desirable cross-sectional shape, longitudinal length "L", thickness, and/or distance of projection from the central portion 225.

FIG. 2A illustrates a separator 200 in which respective projections extend from longitudinally spaced locations that are arranged immediately adjacent to one another along a longitudinal length of the separator 200. By contrast, the separator 220 of FIG. 2B includes longitudinal gaps or spaces between longitudinally adjacent projections. In other words, a first projection 230A may extend from a first longitudinally spaced location, a second projection 230B may extend from an adjacent second longitudinally spaced location, and a longitudinal space or gap "G" may be present between the first and second longitudinally spaced locations. Any suitable longitudinal gap "G" or spacing may be present between adjacent projections at spaced longitudinal locations. Examples of suitable gaps are described in greater detail above. In certain embodiments, the gaps may be formed in accordance with any desired pattern. In other embodiments, the gaps may be formed in a random or pseudo-random manner.

FIG. 2C illustrates a perspective view of another example separator 240 that may be utilized in accordance with various embodiments of the disclosure. The separator 240 may include a central portion 242, and a plurality of projections 244A-J may extend from the central portion 242 at spaced locations along its longitudinal length. In contrast to the separators 200, 220 of FIGS. 2A and 2B, the separator 240 may include two projections that extend from the central portion 242 at each longitudinally spaced location. Additionally, the directions of projection may alternate by approximately one hundred and eighty degrees (180°) between adjacent longitudinally spaced locations. For example, a first set of projections 244A, 244B at a first location may extend in opposite directions from the central portion 242. A second set of projections 244C, 244D at a second location may then extend in opposite directions from the central portion 242 that are perpendicular to the directions of projection for the first set of projections 244A, 244B. A similar alternating pattern may then be repeated along a longitudinal length of the separator 240.

With continued reference to FIG. 2C, one or more longitudinal channels 246 may extend through the central portion 242 of the separator 240. Additionally, in certain embodiments, one or more secondary channels 248 may extend between the longitudinal channel(s) 246 and an outer surface of the separator 240. The separator 240 may also incorporate shielding material in certain embodiments. As shown, each of the projections 244A-J may be formed from a shielding material. In other embodiments, shielding material may be incorporated into a portion of projections 244A-J and/or into the central portion 242.

FIG. 2D illustrates a perspective view of another example separator 250 that may be utilized in accordance with various embodiments of the disclosure. The separator 250 may include a central portion 252, and a plurality of projections 254A-J may extend from the central portion 252 at spaced locations along its longitudinal length. Similar to the separator 240 of FIG. 2C, two respective projections may extend from the central portion 252 at each longitudinally spaced location. However, rather than the two projections extending in opposite directions at each longitudinally spaced location, the two projections may extend in perpendicular directions. The directions of projections may then be alternated by approximately one hundred and eighty degrees (180°) between adjacent longitudinally spaced locations. For example, a first set of projections 254A, 254B at a first location may extend in leftward and upward directions from the central portion 252. A second set of projections 254C, 254D at a second location may then extend in rightward and downward directions from the central portion 252. A similar alternating pattern may then be repeated along a longitudinal length of the separator 250. Additionally, the separator 250 of FIG. 2D illustrates the incorporation of shielding material into one or more of the projections 254A-J. As shown, electrically conductive material may be adhered to, deposited on, otherwise formed on, or otherwise attached to an outer surface of one or more projections 254A-J.

FIG. 2E illustrates a perspective view of another example separator 260 that may be utilized in accordance with various embodiments of the disclosure. The separator 260 may include a central portion 262, and a plurality of projections 264A-L may extend from the central portion 262 at spaced locations along its longitudinal length. As shown, three respective projections may extend from the central portion 262 at each longitudinally spaced location. Additionally, an omitted projection (i.e., an omitted projection that would extend in a fourth quandrantile direction relative to the other three projections) may be alternated by approximately ninety degree (90°) angles between adjacent spaced locations along the longitudinal length. In other embodiments, an omitted projection may be varied in accordance with any other desired patter or, alternatively, in a random or pseudo-random manner. Additionally, in certain embodiments, longitudinal gaps "G" may be present between any number of adjacent longitudinally spaced locations at which projections extend. The separator 260 of FIG. 2E also illustrates the incorporation of shielding material into one or more of the projections 264A-L. As shown, one or more projections 264A-L may be formed from or may otherwise incorporate semi-conductive material.

FIG. 2F illustrates another example separator 270 in which three respective projections extend from a central portion at each of a plurality of longitudinally spaced locations. Additionally, an omitted projection may be alternated or otherwise varied, for example by approximately ninety degree (90°) angles, along the longitudinal length. However, the separator 270 does not include longitudinal gaps between the spaced locations at which projections extend. As a result, single projections may extend through a plurality of adjacent longitudinally spaced locations until a location at which an omitted projection is reached. Additionally, in certain embodiments, shielding material may be incorporated into the separator 270. As shown, a plurality of discontinuous patches of shielding material may be formed on one or more of the projections. Other suitable shielding arrangements may be utilized as desired.

FIGS. 2G and 2H illustrate example separators 280, 290 in which different projections may be formed with different dimensions. For example, with reference to FIG. 20, a separator 280 may include projections with different longitudinal lengths. As shown, a first set of projections 282A, 282B extending from a first longitudinally spaced location may have a first longitudinal length "$L_1$". A second set of projections 284A, 284B extending from a second longitudinally spaced location adjacent to the first longitudinally spaced location may have a second longitudinal length "$L_2$" different form the first longitudinal length "$L_1$". Additionally, FIG. 2G illustrates a central portion 286 that includes shielding material, such as a plurality of discontinuous patches of shielding material formed on a surface of the central portion 286. FIG. 2H illustrates an example separator 290 in which different projections are formed with different cross-sectional shapes and different materials. For example, a first set of projections 292A, 292B extending from a first longitudinally spaced location may have trapezoidal cross-sectional shapes and be formed from a first set of materials, such as one or more shielding materials. A second set of projections 294A, 294B extending from a second longitudinally spaced location adjacent to the first longitudinally spaced location may have a rectangular cross-sectional shape and be formed from a second set of materials, such as one or more dielectric materials. A wide variety of other variations of projection dimensions and/or materials may be utilized in accordance with separators as desired in other embodiments.

The separators illustrated and described above with reference to FIGS. 2A-2H are provided by way of example only. A wide variety of other separator constructions may be utilized as desired in various embodiments. Additionally, a separator may be formed with any suitable arrangement of projections. The components of a separator, such as a central portion and any of the projections, may also be formed with a wide variety of suitable dimensions and/or from a wide variety of suitable materials. As desired, any of the separator features discussed above may be combined in any suitable combination to form a separator. Further, although each of the separators discussed above with reference to FIGS. 2A-2H has an equal number of projections extending from each longitudinally spaced location, separators may be formed that include different numbers of projections extending from at least two longitudinally spaced locations.

Example Projections

As set forth above, projections (e.g., such as bristle 130) may be formed with a wide variety of suitable dimensions, such as a wide variety of suitable longitudinal lengths, distances of projections, thicknesses, and/or cross-sectional areas. Additionally, projections may be formed from a wide variety of suitable materials and/or combinations of materials. FIGS. 3A-3F illustrate cross-sectional views of a few example projections that may be utilized in accordance with various embodiments of the disclosure. FIGS. 4A-4E illustrate cross-sectional views of example material constructions that may be utilized in association with any suitable projections. Each of these figures is discussed in greater detail below.

Figure 3A:
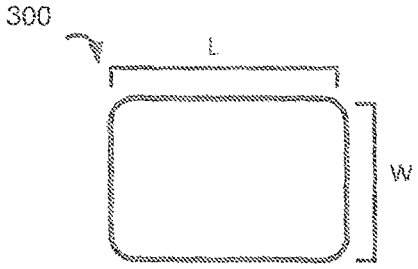
FIGS. 3A-3F are cross-sectional views of example projections that may be incorporated into separators in accordance with various embodiments of the disclosure.
Figure 3B:
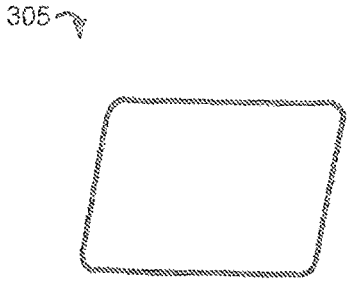
Figure 3C:
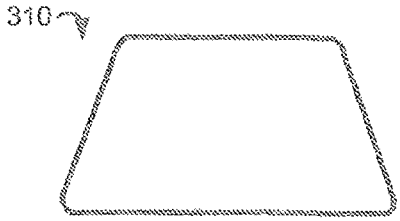
Figure 3D:
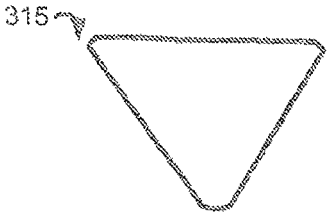
Figure 3E:
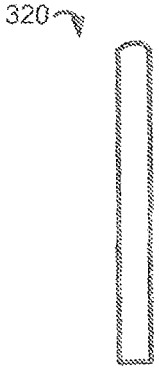
Figure 3F:
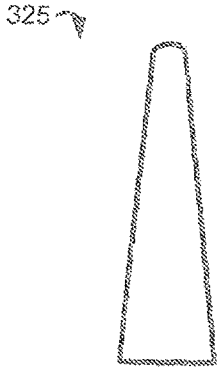

Turning first to FIG. 3A, a first example projection 300 having a rectangular cross-sectional shape is illustrated. The projection 300 may be formed with any suitable longitudinal length "L", distance of projection "W", thicknesses, and/or other dimensions. As desired, one or more corners may be rounded, curved, beveled or otherwise modified. FIG. 3B illustrates a second example projection 305 having a parallelogram cross-sectional shape. FIG. 3C illustrates a third example projection 310 having a trapezoidal cross-sectional shape. In certain embodiments, a longer base of the projection 310 may be positioned adjacent to a central portion. In other embodiments, a shorter base of the projection 310 may be positioned adjacent to a central portion. FIG. 3D illustrates a fourth example projection 315 having a triangular cross-sectional shape. In certain embodiments, the triangular base may be positioned adjacent to the central portion, and the projection 315 may taper or narrow as it extends. In other embodiments, the projection 315 may have a relatively narrow end (e.g., a point or rounded end, etc.) positioned adjacent to a central portion, and the projection 315 may expand as it extends away from the central portion. FIG. 3E illustrates a fifth example projection 320 having a spike cross-sectional shape. In other words, a projection 320 may be formed with a relatively small longitudinal length in order to reduce or minimize the material utilized in a separator. Additionally, when viewed from an end, a pike projection may have any suitable shape, such as a circular, square, rectangular, hexagonal, octagonal, or other suitable shape. FIG. 3F illustrates another example projection 325 having a spike cross-sectional shape; however, the projection 325 may have a larger base than tip, which may provide further separation between adjacent twisted pairs. Additionally, a wide variety of other suitable cross-sectional shapes may be utilized as desired in association with bristles, and those illustrated in FIGS. 4A-4G are provided by way of non-limiting example only.

Figure 4A:
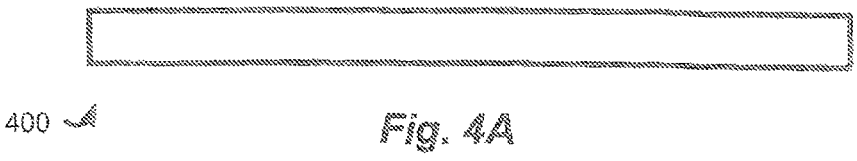
FIGS. 4A-4E are cross-sectional views of example material constructions that may be utilized to form separators and/or projections incorporated into separators, according to illustrative embodiments of the disclosure.
Figure 4B:
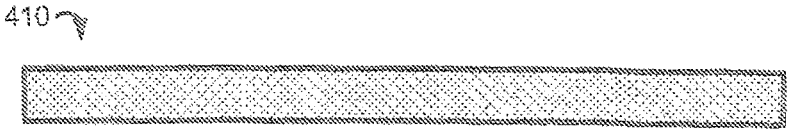
Figure 4C:
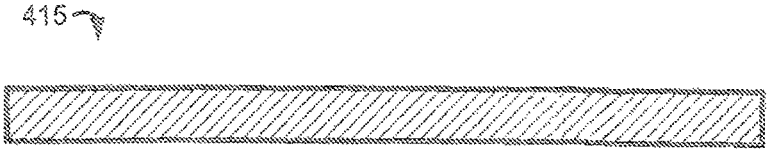
Figure 4D:
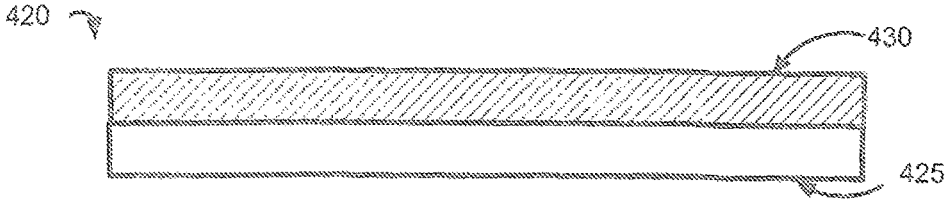
Figure 4E:
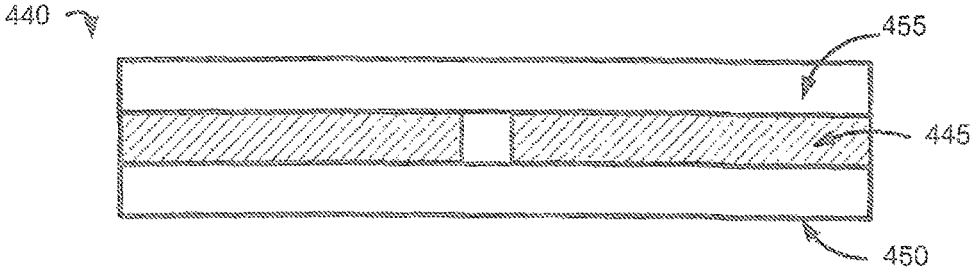

Additionally, as illustrated in FIGS. 4A-4E, projections may be formed from a wide variety of suitable materials and/or combinations of materials. The illustrated material constructions are equally applicable to projections having a wide variety of different cross-sectional shapes. FIG. 4A illustrates a first example material construction 400 that includes one or more dielectric materials. FIG. 4B illustrates a second example material construction 410 that includes one or more semi-conductive materials. FIG. 4C illustrates a third example material construction 415 that includes one or more electrically conductive materials. FIG. 4D illustrates a fourth example material construction 420 in which a layer of electrically conductive material 430 (e.g., patches of shielding material, etc.) may be formed on a base dielectric layer 425. FIG. 4E illustrates a fifth example material construction 440 in which an electrically conductive layer 445 may be sandwiched between two dielectric layers. 450, 455. A wide variety of other material constructions may be utilized in association with projections as desired in various embodiments, and those illustrated in FIGS. 4A-4E are provided by way of non-limiting example only. As desired, any number of suitable layers of material may be utilized to form a projection. Additional, although the example material constructions illustrated in FIGS. 4A-4E are described as being associated with projections, it will be appreciated that any of the material constructions are equally applicable to separator central portions or spines. For example, a central portion may also be formed from any suitable materials and/or combinations of materials. Further, a central portion may be formed with any suitable number of layers and/or material configurations.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cable comprising:

a plurality of twisted pairs, each of the plurality of twisted pairs comprising two individually insulated electrical conductors that extend along a longitudinal direction;

a separator comprising:

a longitudinally extending spine positioned between the plurality of twisted pairs; and a first set of projections respectively extending away from the spine in a first direction at a first plurality of spaced locations along a longitudinal length of the spine, each projection included in the first set of projections being non-continuous along the longitudinal length of the spine and having a distance of projection from the spine that is at least approximately half the diameter of one of the plurality of twisted pairs; and a second set of projections respectively extending away from the spine in a second direction different than the first direction at a second plurality of spaced locations along the longitudinal length of the spine different than the first plurality of spaced locations, each projection included in the second set of projections being non-continuous along the longitudinal length of the spine and having a distance of projection from the spine that is at least approximately half the diameter of one of the plurality of twisted pairs;

a third set of projections respectively extending away from the spine in a third direction different than the first and second directions at a third plurality of spaced locations along the longitudinal length of the spine different than the first and second pluralities of spaced locations, each projection included in the third set of projections being non-continuous along the longitudinal length of the spine and having a distance of projection from the spine that is at least approximately half the diameter of one of the plurality of twisted pairs; and a fourth set of projections respectively extending away from the spine in a fourth direction different than the first, second, and third directions at a fourth plurality of spaced locations along the longitudinal length of the spine different than the first, second, and third pluralities of spaced locations, each projection included in the fourth set of projections being non-continuous along the longitudinal length of the spine and having a distance of projection from the spine that is at least approximately half the diameter of one of the plurality of twisted pairs, wherein no more than a single projection included in any of the first, second, third, and fourth sets of projections extends from the spine at any given cross-sectional location along the longitudinal length of the spine, and wherein the projections included in the first, second, third, and fourth sets of projections extend from the spine and alternate between the first, second, third, and fourth sets of projections in approximately ninety degree increments along the longitudinal length of the spine;

a jacket formed around the plurality of twisted pairs and the separator.

2. The cable of claim 1, wherein each projection included in either the first, second, third, or fourth sets of projections comprises one of a rectangular, parallelogram, trapezoidal, or triangular cross-sectional shape.

3. The cable of claim 1, further comprising shielding material incorporated into at least one projection included in either the first, second, third, or fourth set of projections.

4. A cable comprising:

a plurality of twisted pairs, each of the plurality of twisted pairs comprising two individually insulated electrical conductors that extend along a longitudinal direction;

a separator comprising:

a longitudinally extending spine positioned between the plurality of twisted pairs; and a first set of prongs extending away from the spine at a first location along a longitudinal length of the spine, each prong included in the first set of prongs being non-continuous along the longitudinal length of the spine and having a distance of extension from the spine that is at least approximately half the diameter of one of the plurality of twisted pairs;

a second set of prongs extending away from the spine at a second location along the longitudinal length of the spine, each prong included in the second set of prongs being non-continuous along the longitudinal length of the spine and having a distance of extension from the spine that is at least approximately half the diameter of one of the plurality of twisted pairs;

a third set of prongs extending away from the spine at a third location along the longitudinal length of the spine, each prong included in the third set of prongs being non-continuous along the longitudinal length of the spine and having a distance of extension from the spine that is at least approximately half the diameter of one of the plurality of twisted pairs; and a fourth set of prongs extending away from the spine at a fourth location along the longitudinal length of the spine, each prong included in the fourth set of prongs being non-continuous along the longitudinal length of the spine and having a distance of extension from the spine that is at least approximately half the diameter of one of the plurality of twisted pairs, wherein, the first set of prongs extends away from the spine in a first set of one or more directions and the second set of prongs extends away from the spine in a second set of one or more directions that is different than the first set of one or more directions, wherein no more than a single prong included in any of the first, second, third or fourth sets of prongs extends away from the spine at any given cross-sectional location along the longitudinal length, and wherein the prongs included in the first, second, third, and fourth sets of prongs extend from the spine and alternate in approximately ninety degree increments between the first, second, third, and fourth sets of projections; and a jacket formed around the plurality of twisted pairs and the separator.

5. The cable of claim 4, wherein each of the prongs included in the first, second, third, and fourth sets of prongs comprises one of a rectangular, parallelogram, trapezoidal, or triangular cross-sectional shape.

6. The cable of claim 4, further comprising shielding material incorporated into at least one prong included in either the first, second, third, or fourth set of prongs.

7. The cable of claim 4, further comprising a longitudinal gap along the longitudinal length of the spine between the first set of prongs and the second set of prongs.

8. A cable comprising:

four twisted pairs, each of the four twisted pairs comprising two individually insulated electrical conductors that extend along a longitudinal direction;

a cross-filler positioned between the four twisted pairs along a longitudinally length of the cable, the cross-filler comprising a central portion and a plurality of projections extending from the central portion, the plurality of projections comprising respective projections that extend between each adjacent set of the four twisted pairs, wherein, at any given cross-sectional location along the longitudinal length of the cable, the plurality of projections do not extend between all of the adjacent sets of the four twisted pairs, wherein no more than a single projection included in the plurality of projections extends from the central portion at any given cross-sectional location along the longitudinal length, and wherein the directions of extension for the plurality of projections alternate in approximately ninety degree increments along the longitudinal length; and a jacket formed around the four twisted pairs and the cross-filler.

9. The cable of claim 8, wherein each of the plurality of projections comprises one of a rectangular, parallelogram, trapezoidal, or triangular cross-sectional shape.

10. The cable of claim 8, further comprising shielding material incorporated into at least one projection included in the plurality of projections.

* * * * *